US005613416A

United States Patent [19]

Fujita

[11] Patent Number: 5,613,416

[45] Date of Patent: Mar. 25, 1997

[54] PUNCHING TOOL

[75] Inventor: Oriya Fujita, Kanagawa-ken, Japan

[73] Assignee: Amada Metrecs Company, Limited, Kanagawa, Japan

[21] Appl. No.: 607,625

[22] Filed: Feb. 27, 1996

Related U.S. Application Data

[63] Continuation of Ser. No. 252,164, May 31, 1994, abandoned.

[30] Foreign Application Priority Data

Jun. 7, 1993 [JP] Japan ..... 5-136192

[51] Int. Cl.[6] ..... B26F 1/14

[52] U.S. Cl. ..... 83/98; 83/140; 83/636; 83/686

[58] Field of Search ..... 173/210; 83/138–143, 83/543, 98, 146, 686, 636

[56] References Cited

U.S. PATENT DOCUMENTS

| | | | |
|---|---|---|---|
| 3,388,753 | 6/1968 | Bardwell | 173/210 |
| 4,007,653 | 2/1977 | Cady | 83/140 |
| 4,092,888 | 6/1978 | Wilson | 83/140 |
| 4,423,859 | 1/1984 | Muller . | |
| 4,631,996 | 12/1986 | Magnuson . | |
| 4,977,804 | 12/1990 | Naito | 83/98 |
| 5,176,057 | 1/1993 | Chun et al. . | |
| 5,400,682 | 3/1995 | Matsuura | 83/139 |
| 5,410,926 | 5/1995 | Saito | 83/140 |
| 5,410,927 | 5/1995 | Omata et al. | 83/139 |
| 5,419,225 | 5/1995 | Fujita | 83/140 |
| 5,445,057 | 8/1995 | Fujita | 83/140 |

FOREIGN PATENT DOCUMENTS

| | | |
|---|---|---|
| 0220540 | 5/1987 | European Pat. Off. . |
| 5-138260 | 1/1993 | Japan . |
| 2057088 | 3/1981 | United Kingdom . |

OTHER PUBLICATIONS

"Tooling and Production", vol. 50, No. 7, *Squelching Stamping Noise*, Fredrico Strasser, pp. 74–75. date unknown.

European Search Report and Annex Aug. 1994.

English abstract of Japanese Patent Document No. 5–138260. Jun. 1993.

*Primary Examiner*—Kenneth E. Peterson

*Attorney, Agent, or Firm*—Greenblum & Bernstein P.L.C.

[57] ABSTRACT

In a punching tool having a punch body (23), a punch driver (33) integral with the punch body, a punch head (45) disposed over the punch driver and struck by a striker (59), a punch guide (15) for guiding the punch body, a stripper plate (17) disposed under the punch guide, and a stripping spring (51) interposed between the punch guide (15) and the punch driver (33), the punching tool further includes a first damping member (39) interposed between the punch guide (15) and the punch driver (33) so as to be elastically deformable within a predetermined deflection value. Owing to the presence of the first damping member (39), it is possible to reduce noise generated when the punch body (23) is returned upward by a strong urging force of the stripping spring (51) after work has been punched, thus reducing overall noise generated during punching processing.

2 Claims, 6 Drawing Sheets

PUNCHING TOOL

This application is a continuation of application Ser. No. 08/252,164, filed May 31, 1994, now abandoned.

BACKGROUND OF THE INVENTION

1. Field of the Invention

The present invention relates to a punching tool, and more specifically to a punching tool which can reduce punching noise generated during punching processing.

2. Description of the Related Art

Work mounted on a lower die can be punched by moving an upper tool up and down relative to the lower die. During this punching processing, punching noise is inevitably generated. To reduce the generated punching noise, conventionally a damping member such as urethane has been disposed on as tripper plate provided at the lower portion of a punch guide for constituting a part of the upper tool. Or else, the cutting edge of the punch body is formed with a shear angle to reduce the punching noise.

In the conventional method of disposing a damping member such as urethane on the stripper plate provided at the lower portion of the punch guide, there exists a problem in that the work surface is easily scratched because needle-shaped chips generated during punching processing adhere to the damping member. In addition, since the damping member is not durable, there exists another problem in that the life time of the damping member is short and in addition it is rather difficult to mount or bond the damping member on the punch guide. On the other hand, in the conventional method of forming the cutting edge of the punch body with a shear angle, it has been difficult to reduce noise down to a sufficiently low level.

SUMMARY OF THE INVENTION

With these problems in mind, therefore, it is the primary object of the present invention to provide a punching tool which can reduce the noise generated by collision of a punch guide against the lower portion of a punch driver, whenever a punch body is returned by an urging force of as tripping spring after work has been punched.

To achieve the above-mentioned object, the present invention provide a punching tool having a punch body (23), a punch driver (33) integral with the punch body, a punch head (45) disposed over the punch driver and struck by a striker (59), a punch guide (15) for guiding the punch body, as tripper plate (17) disposed under the punch guide, and as tripping spring (51) interposed between the punch guide (15) and the punch driver (38), which further comprises a first damping member (39) interposed between the punch guide (15) and the punch driver (33) so as to be elastically deformable within a predetermined deflection value.

Further, it is preferable that the punching tool further comprises a second damping member (47) interposed between the punch driver (33) and the punch head (45) so as to be elastically deformable.

Further, it is preferable that a cutting edge of the punch body (23) is formed with a shear angle (25).

Further, it is preferable that the punch driver (33) is formed integral with a driver end (31) fixed to a lower portion of the punch driver (33), and said first damping member (39) is interposed between the punch guide (15) and the driver end (31) fixed to the punch driver (33).

In the punching tool according to the present invention, since a first damping member (39) is interposed between the punch guide (15) and the punch driver (33) so as to be elastically deformable within a predetermined deflection value, it is possible to reduce noise generated due to collision of the punch driver against the punch guide, whenever the punch body is returned upward by a strong urging force of the stripping spring after the work has been punched.

Further, since the second damping force is additionally interposed between the upper surface of the punch driver and the lower surface of the punch head and further since the punch body is formed with a shear angle, it is possible to reduce the overall noise generated when work is punched.

DETAILED DESCRIPTION OF THE EMBODIMENTS

An embodiment of the punching tool according to the present invention will be described hereinbelow with reference to the attached drawings.

Figure 1:
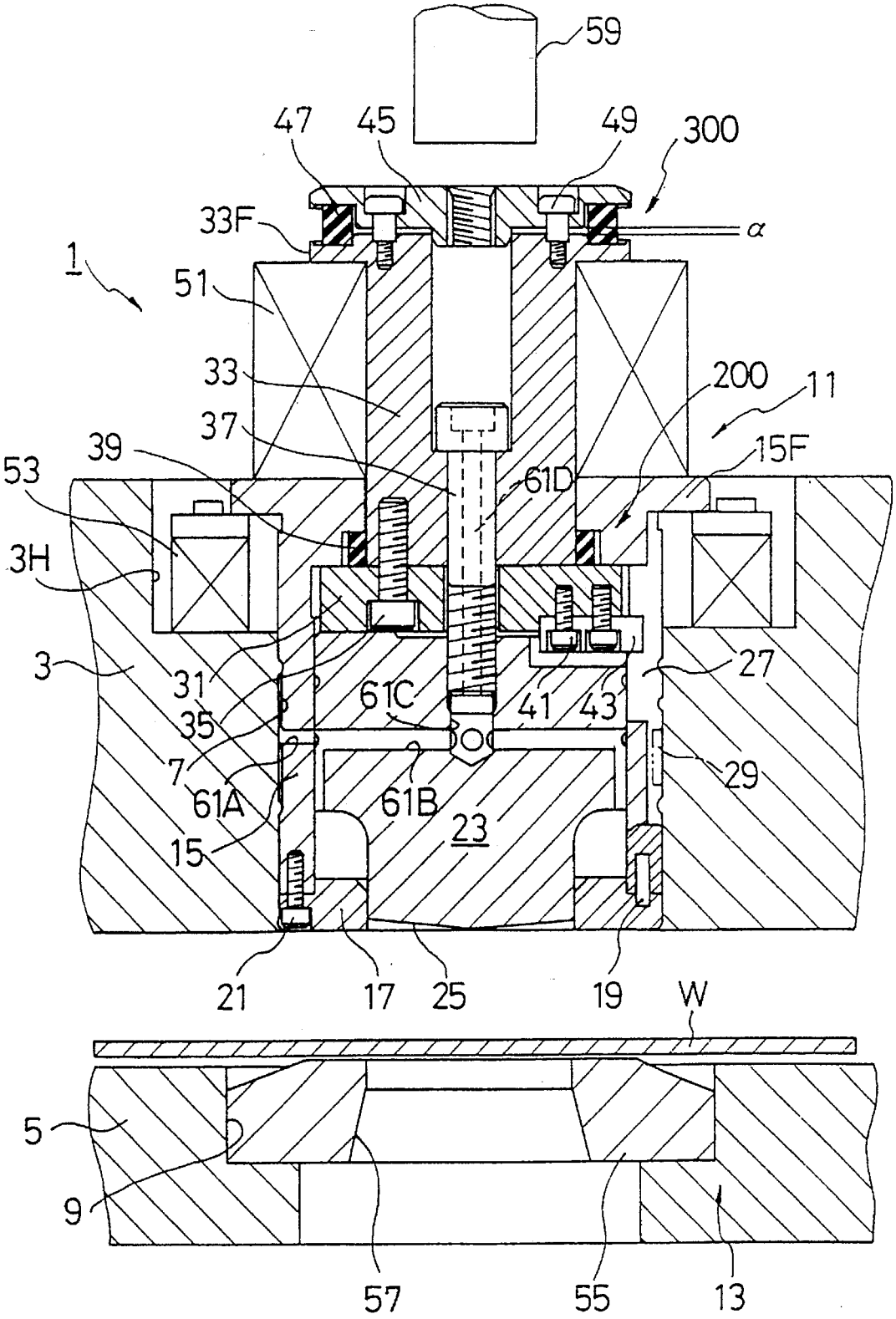
FIG. 1 is a cross-sectional view showing an embodiment of the punching tool according to the present invention, when applied to a turret punch press.

In FIG. 1, a turret punch press 1 (as an example of a punch press) is provided with an upper turret (an upper tool holder) 3 and a lower turret (a lower die holder) 5. The upper turret 3 is formed with a plurality of turret holes 7 at regular angular intervals along the circumference thereof. Further, an upper tool 11 (as the punching tool) is fitted to the turret hole 7, respectively. In the same way, the lower turret 5 is formed with a plurality of turret holes 9 at regular angular intervals along the circumference thereof. Further, a lower die 13 (as the punching tool) is fitted to the turret hole 9, respectively.

FIG. 1 shows a die structure, in which only a single pair of the upper tool 11 and the lower die 13 are fitted to the turret holes 7 and 9, respectively. In more detail, a punch guide 15 movable up and down (which constitutes a part of the upper tool 11) is fitted to the turret hole 7. Under the punch guide 15, a stripper plate 17 is located (with respect to the direction) with the use of a straight pin 19 and further mounted with the use of a bolt 21.

To the punch guide 15, a punch body 23 movable up and down is fitted. Further, the cutting edge of the punch body 23 is formed with a shear angle 25. Further, the punch body 23 is formed with a key groove 27. With this key groove 27, a key 29 formed in an upper turret 3 is engaged.

At the upper portion of the punch body 23, a punch driver 33 is fixed via a cylindrical driver end 31. That is, the punch end 31 is fixed to the punch driver 33 with a bolt 35, and further the punch driver 33 is fixed to the punch body 23 with a bolt 37, respectively.

Figure 2:
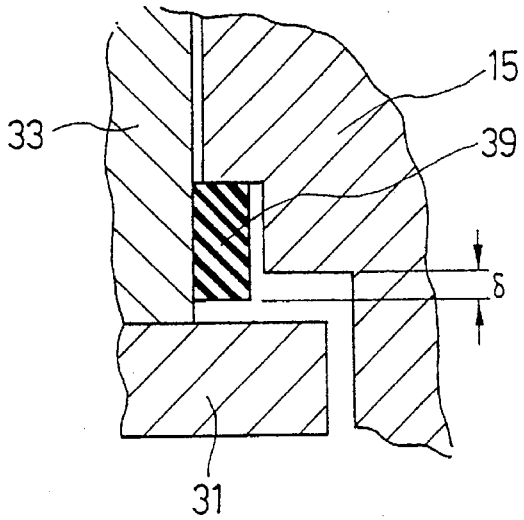
FIG. 2 is an enlarged cross-sectional view showing the same punching tool, when seen from an arrow 200 shown in FIG. 1.

Further, as is well shown in FIG. 2, a first damping member such as urethane having a predetermined deflection range δ interposes between the punch guide 15 and driver end 31. Further, a guide key 43 is fixed to the driver end 31 with a plurality of bolts 41. This guide key 43 is also engaged with the key groove 27.

Figure 3:
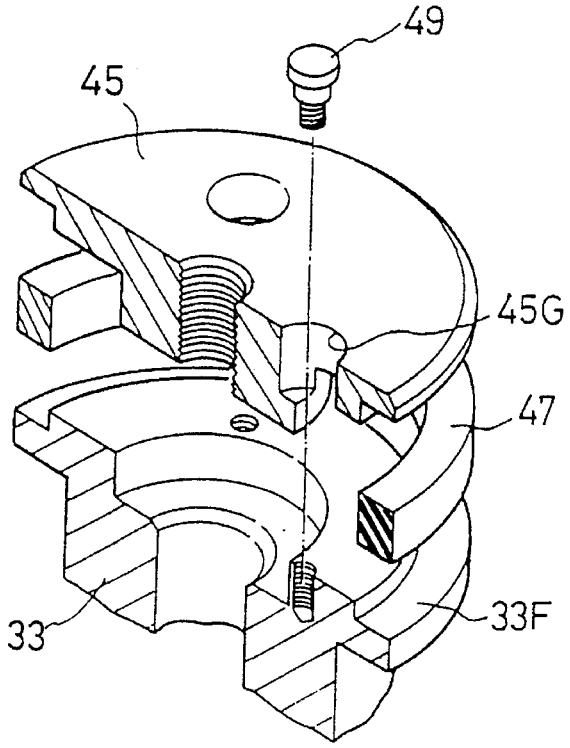
FIG. 3 is an enlarged, partially cross-sectional, perspective view showing the same punching tool, when seen from an arrow 300 shown in FIG. 1.

Over the punch driver 33, a punch head 45 is provided. A second damping member 47 such as urethane is interposed between an upper surface of a flange portion 33F of the punch driver 33 and a lower surface of the punch head 45. Further, a gap α is produced between the punch driver 33 and the punch head 45. As well shown in FIG. 3, the punch head 45 is fixed to the punch driver 33 with a plurality of bolts 49 passed through imbedding holes 45G formed in the punch head 45.

A stripping spring 51 for urging the punch driver 33upward is interposed between the upper surface of the punch guide 15 and the flange portion 33F of the punch driver 33. Further, a lift spring 53 for urging the punch guide 15 always upward is,interposed between the bottom surface of a hole 3H formed in the upper turret 3 and the flange portion 15F of the punch guide 15.

On the other hand, a die 55 for constituting a lower die 13 is fitted to a turret hole 9 formed in the lower turret 5. This die 55 is formed with a die hole 57 with which the punch body 23 is engaged.

Over the punch head 45, a striker 59 movable up and down is mounted on an upper frame (not shown) which constitutes a part of the turret punch press 1. Further, air blow passages 61A, 61B, 61C and 61D are formed in the punch guide 15, the punch body 23 and the bolt 37, respectively in order to discharge chips (produced during punching processing) to the outside thereof.

In the construction as described above, since the defection of the first damping member 39 interposed between the punch guide 15 and the driver end 31 is limited within a predetermined deflection range δ, it is possible to improve the durability of the first damping member 39. In addition, since a gap α of the punch body 33 and the lower surface of the punch head 45, it is possible to limit the necessary deflection rate of the second damping member 47, so that the durability of the second damping member 47 can be also improved. In addition, as shown in FIG. 1, punch driver 33 has a smaller radius than driver end 31, for forming an annular recess bounded by punch guide 15, punch driver 33 and driver end 31. The first damping member 39 is ring shaped, with an inner diameter approximately equal to the diameter of the punch driver, and an outer diameter smaller than the diameter of the driver end.

Figure 4:
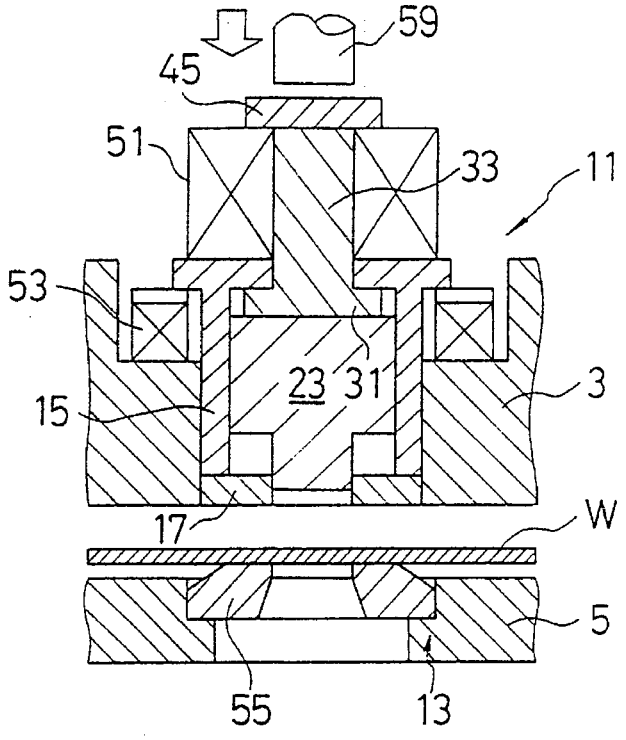
FIGS. 4 to 10 are cross-sectional views for assistance in explaining the noise generating sequence of the punching tool according to the present invention.
Figure 5:
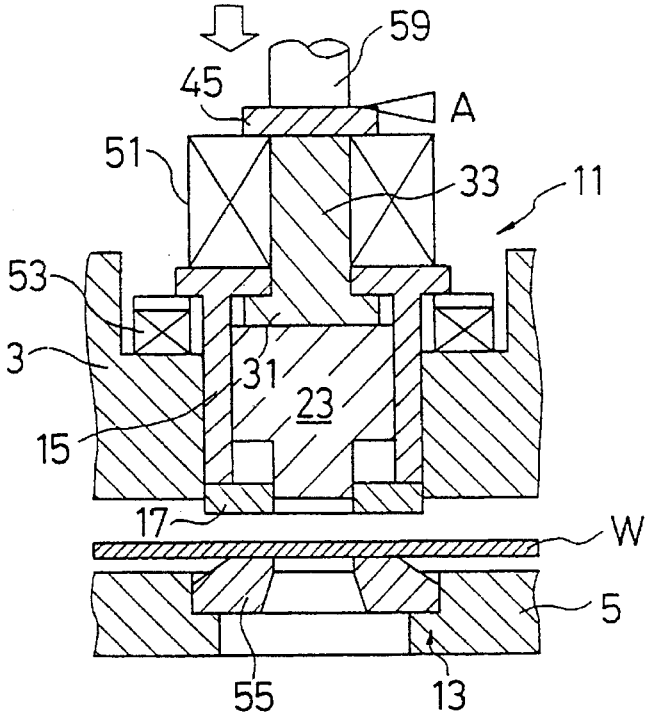
Figure 6:
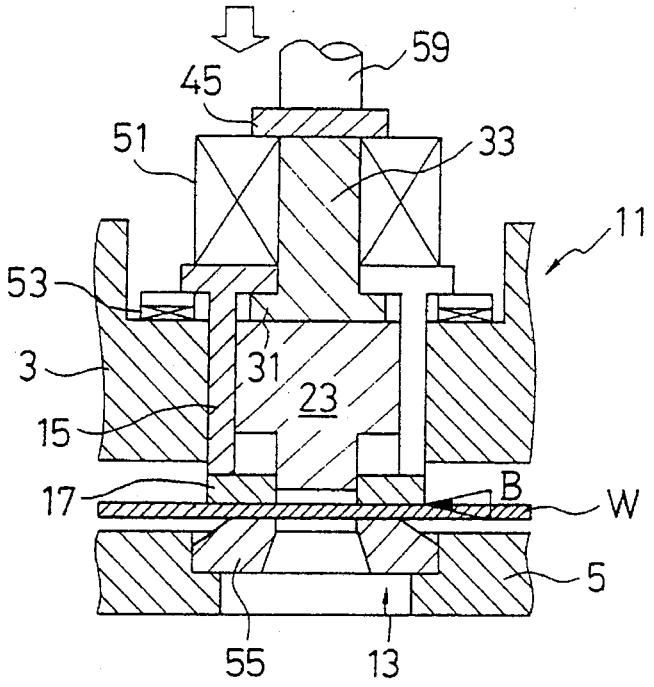
Figure 7:
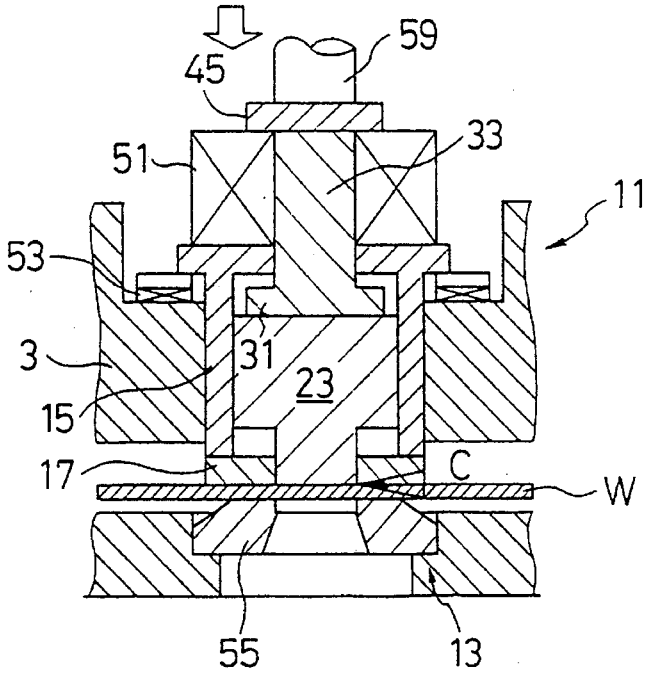
Figure 8:
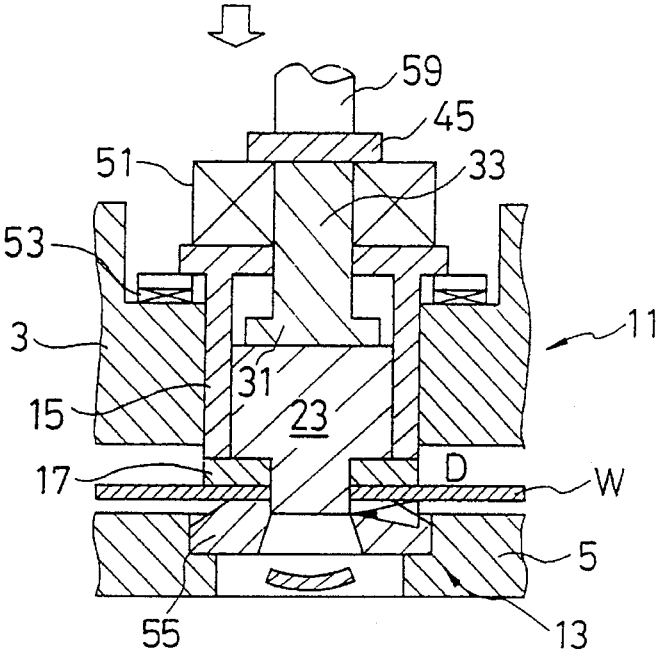
Figure 9:
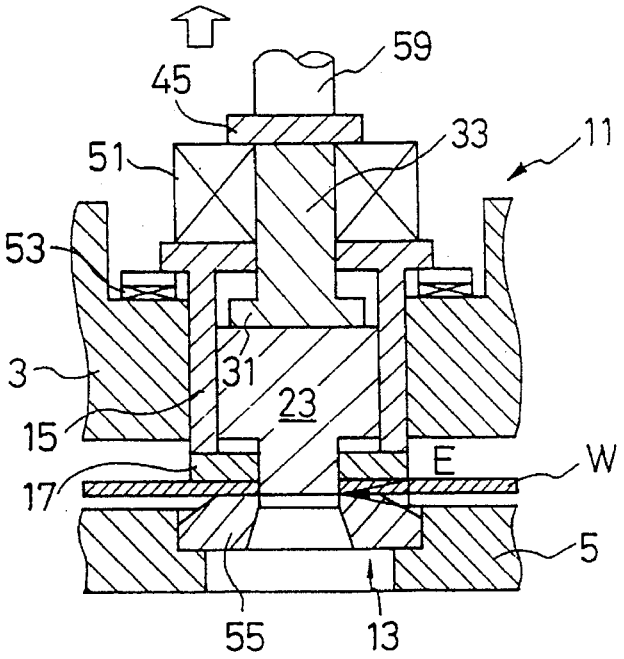
Figure 10:
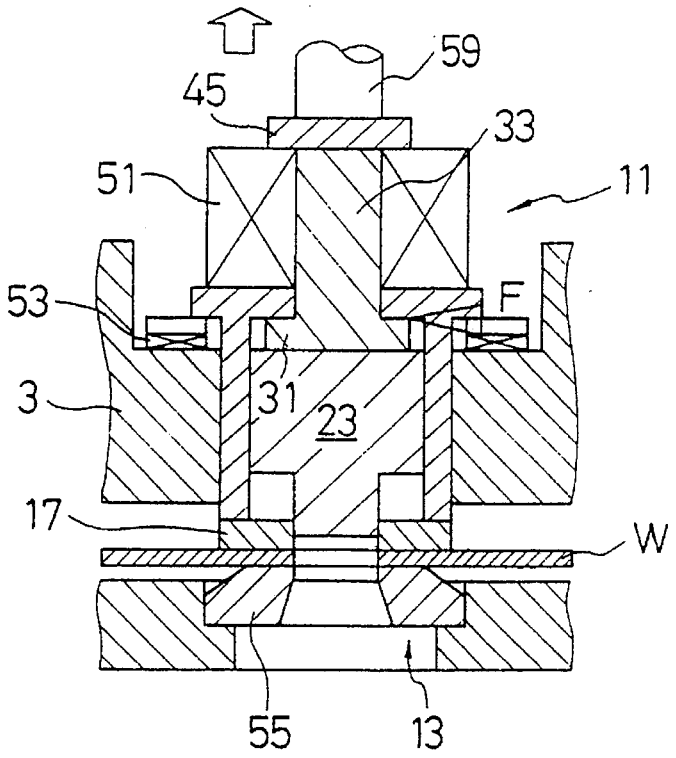

FIG. 4 to 10 show the operation sequence during the punching processing, in which work W mounted on the lower die 13 is punched in cooperation of the upper tool 11 and the lower die 13. In more detail, FIG. 4 shows the initial state; FIG. 5 shows the state where the striker 59 is lowered to strike the punch head 45 so that a sound A is generated when the striker 59 collides against the punch head 45; FIG. 6 shows the state where the stripper plate 17 and the cutting edge of the punch body 23 both begin to be brought into tight contact with the work W so that a sound B is generated when the stripper plate 17 collides against the work W and the stripper plate 17 collides against the die 55; FIG. 7 shows the state where the work W is punched out by the cutting edge of the punch body 23 so that a sound C is generated when the cutting edge of the punch body 23 begins to cut the work W; FIG. 8 shows the state where the cutting edge of the punch body 23 shears the work W so that a sound D is generated when the work W is broken off; FIG. 9 shows the state where the punch body 23 is returned by the urging force of the stripping spring 51 after the work W has been punched so that a sound E is generated by a resistance caused when the cutting edge of the punch body 23 caught by the work W is returned by the stripping spring 51; and FIG. 10 shows the state where the punch body 23 is strongly returned by the stripping spring 51 so that a sound F is generated when the driver end 31 collides against the punch guide 15.

Figure 11:
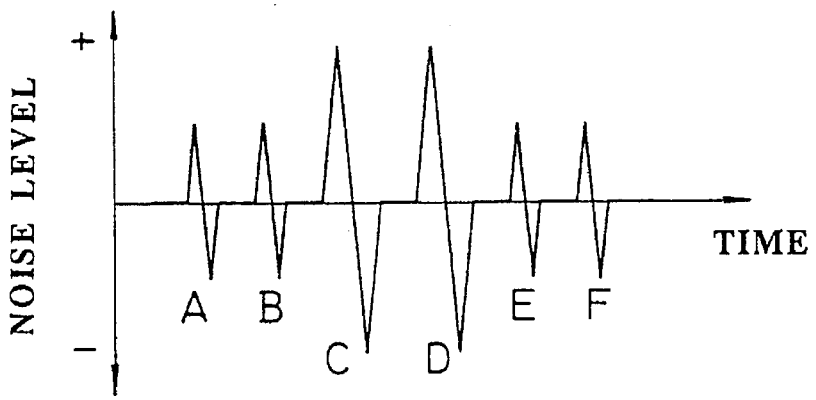
FIG. 11 is a graphical representation showing the measured noise levels of the respective elements of the punching tool, which are generated during punching processing.

FIG. 11 shows the measured values of the sound noises A to F generated at the respective operational processes. FIG. 11 indicates that: The sound A can be reduced because the second damping member 47 is interposed between the punch driver 33 and the punch head 45. The sound B can be reduced because a gap α is produced between the punch driver 33 and the punch head 45 and in addition the second damping member 47 is interposed between the punch driver 33 and punch head 45, and the load curve of the stripping spring 51 is gentled by the second damping member 47. The sound C can be reduced because the punch body 23 is formed with a shear angle 25, so that the punch body 23 can easily start cutting the work W. The sound D can be also reduced because the punch body 25 is formed with the shear angle 25. Further, since the punching load can be reduced, the deflection of the press machine frame can be decreased, so that the noise generated by the press machine body can be also lowered. In the same way, the sound E can be reduced because the punch body 23 is formed with a shear angle 25, so that the resistance is increased gradually when the cutting edge of the punch body 23 starts to cut the work W without generating a large resistance at a time. Further, the sound F can be reduced because the first damping member 39 is interposed between the punch guide 15 and the driver end 31.

As described above, in the punching tool according to the present invention, since various noise reduction countermeasures are taken into account for each of the respective sounds A to F, it is possible to suppress the noise all over the punching tool effectively, while improving the durability of the first and second damping members 39 and 47 simultaneously.

Further, the punching tool of the present invention is not limited to only the embodiment as described above, and various changes and modifications may be made in the invention, without departing from the spirit and the scope of the invention as claimed.

As described above, in the punching tool according to the present invention, since the first damping member is interposed between the punch guide and the punch driver, when the punch body is strongly returned by the stripping spring, it is possible to reduce the noise generated by collision between the punch guide and the punch driver, so that the noise generated during the punch processing can be reduced effectively.

In addition, since a second damping member is interposed between the punch driver and the punch head and further the cutting edge of the punch body is formed with a shear angle, it is possible to reduce the noise generated due to other remaining noise generating factors during punching processing, thus reducing the noise generated during punching processing synthetically.

What is claimed is:

1. A punching tool struck by a striker for punching a work, the punching tool comprising:

a punch body having a cutting edge formed with a shear angle;

a punch driver, integral with the punch body, having an upper portion and a lower driver end portion having first and second diameters, respectively, said second diameter being larger than said first diameter;

a punch head disposed over the punch driver and struck by the striker;

a punch guide for guiding movement of the punch body during punching;

a stripper plate disposed under the punch guide;

a stripping spring interposed between the punch guide and the punch driver;

a first damping member interposed between the punch guide and the punch driver so as to be elastically deformable within a predetermined first deflection value, the first dampening member having an outer diameter smaller than the second diameter and an inner diameter substantially equal to the first diameter;

a second damping member interposed between the punch driver and the punch head so as to be elastically deformable with a predetermined second deflection value; and the first dampening member being disposed in an annular recess bounded by an inner wall of said punch guide, and the upper and lower portions of the punch driver.

2. The punching tool struck of claim 1, wherein the punch guide and the punch body have air blow passages formed therein below the annular recess for discharging chips produced during punching.

* * * * *